United States Patent [19]

Baldwin et al.

[11] 4,218,019

[45] Aug. 19, 1980

[54] AIR SHROUD DEVICE FOR PAINT SPRAY GUNS

[75] Inventors: Jack W. Baldwin, Royal Oak; Jonathon D. Carlson, Detroit, both of Mich.

[73] Assignee: General Motors Corporation, Detroit, Mich.

[21] Appl. No.: 66,806

[22] Filed: Aug. 15, 1979

[51] Int. Cl.[3] ..... B05B 7/08

[52] U.S. Cl. ..... 239/290; 239/112; 239/500; 239/590.5

[58] Field of Search ..... 239/105, 112, 113, 290, 239/291, 500, 548, 590.5

[56] References Cited

U.S. PATENT DOCUMENTS

| | | | |
|---|---|---|---|
| 2,410,532 | 11/1946 | Tessier | 239/291 |
| 2,478,557 | 8/1949 | Bell et al. | 239/291 X |

FOREIGN PATENT DOCUMENTS

| | | | |
|---|---|---|---|
| 1452929 | 9/1966 | France | 239/291 |

*Primary Examiner*—Robert W. Saifer
*Attorney, Agent, or Firm*—R. L. Phillips

[57] ABSTRACT

An air shroud device for a paint spray gun is provided with an improved air distributing arrangement which evenly distributes air about and also both toward and in the same direction as the paint spray issuing from the nozzle to form a uniform air shroud thereabout as well as prevent paint from building up on the air shroud device.

2 Claims, 4 Drawing Figures

AIR SHROUD DEVICE FOR PAINT SPRAY GUNS

This invention relates to an air shroud device for paint spray guns and more particularly to such an air shroud device having an improved air distributing arrangement and simplified maintenance.

In the application of paint with a spray gun, it is known that certain benefits may be gained by establishing a shroud of air of certain temperature and humidity about the paint spray. For example, in applying an aqueous paint, it is known that a finish of excellent quality can result from encircling the aqueous paint spray with shroud of air of relatively high temperature and low humidity. For example, see U.S. Pat. No. 3,857,511 and U.S. Pat. application Ser. No. 953,195 assigned to the assignee of the present invention.

The air shroud device according to the present invention provides improved performance as well as enabling simple maintenance thereof. In the preferred embodiment, the air shroud device or assembly comprises three main parts; namely a vaned insert, a collar and a shell which is fixed to the collar and to which the vane insert is clamped and may be readily removed therefrom for cleaning. The collar is adapted to be received about and detachably fixed to the gun and the vaned insert and shell form an annular air passage which extends about the nozzle. An air inlet is provided in the shell for delivering air at the desired humidity and temperature in opposite directions into semi-annular branches of the air passage. A series of first air outlets are spaced along these branches for delivering air therefrom in the same direction as and about the paint spray issuing from the nozzle. These air outlets are formed in part by a series of vanes on the vaned insert which are spaced along and extend transversely of the branches and have entrance edges which project at varying distances into the air passage. The entrance edges of the vanes in each of the branches project progressively longer distances into the air passage at successively further downstream locations relative to the inlet so that the entrance edge of the vane in each branch projects further into the oncoming air than the preceeding upstream vane in this branch. As a result, the air is substantially evenly distributed between the vanes and thus to the associated outlets to thereby form a uniform air shroud about the paint spray to promote excellent quality paint application. In addition, a second series of air outlets are provided which are spaced along the branches for delivering air therefrom inward toward and about the paint spray where it is issuing from the nozzle to prevent paint build-up on the air shroud device. Each of the latter outlets are located in the vaned insert on the upstream side and adjacent the entrance edge of one of the vanes so that the air is substantially evenly distributed between these latter outlets to most efficiently prevent paint build-up on the air shroud device.

An object of the present invention is to provide a new and improved air shroud device for a paint spray gun.

Another object is to provide an air shroud device for a paint spray gun having a new and improved air distribution arrangement.

Another object is to provide an air shroud device for a paint spray gun enabling simple and improved maintenance.

Another object is to provide an air shroud device for a paint spray gun having an air distribution arrangement for forming an air shroud about the paint spray issuing from the spray gun nozzle as well as preventing paint build-up on the air shroud device.

These and other objects of the present invention will become more apparent from the following description and drawing in which.

Figure 1:
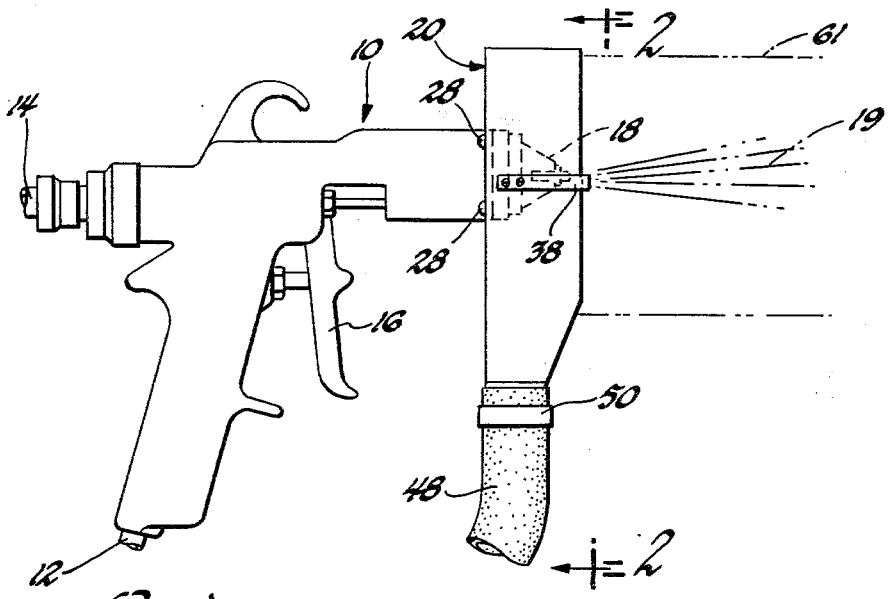
FIG. 1 is an elevational side view of a paint spray gun having an air shroud device according to the present invention.

Referring to FIG. 1, there is shown a paint spray gun 10 of conventional type which is used for spraying a wide variety of paint, such as enamel, lacquer and aqueous-based paints for which use of the present air shroud device may be applied. The paint spray gun 10 has the normal paint feed 12 and air feed 14 and an internal mixing arrangement controlled by a trigger 16 whereby paint spray is caused to issue from nozzle 18 in a generally diverging spray pattern 19.

Figure 2:
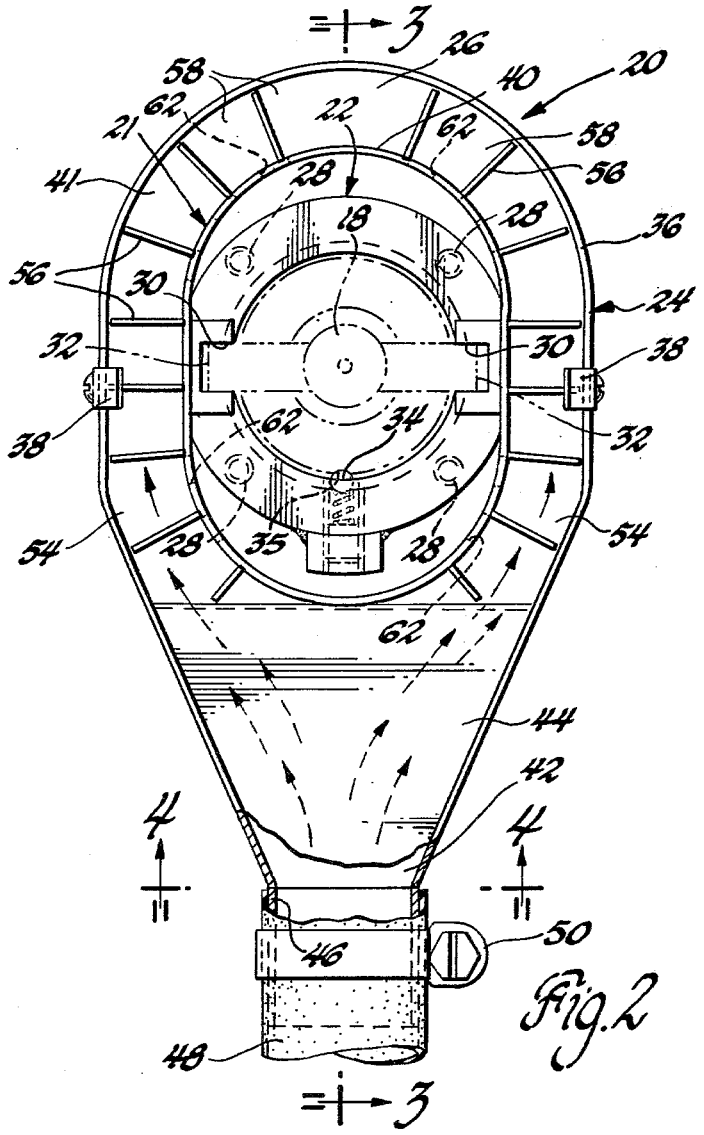
FIG. 2 is an enlarged elevational end view taken along the line 2—2 in FIG. 1.
Figure 3:
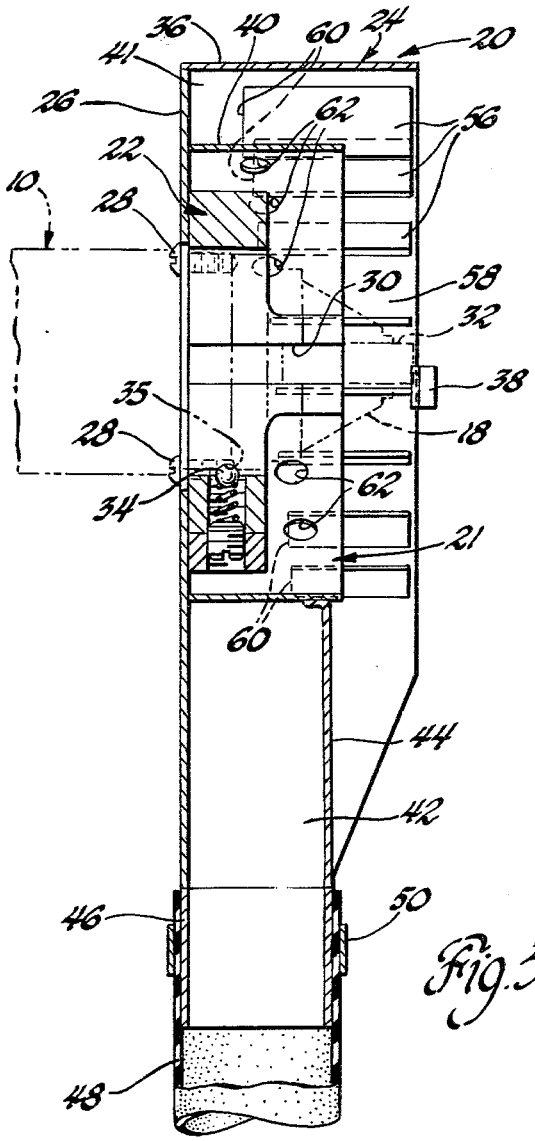
FIG. 3 is a view taken along the line 3—3 in FIG. 2.
Figure 4:
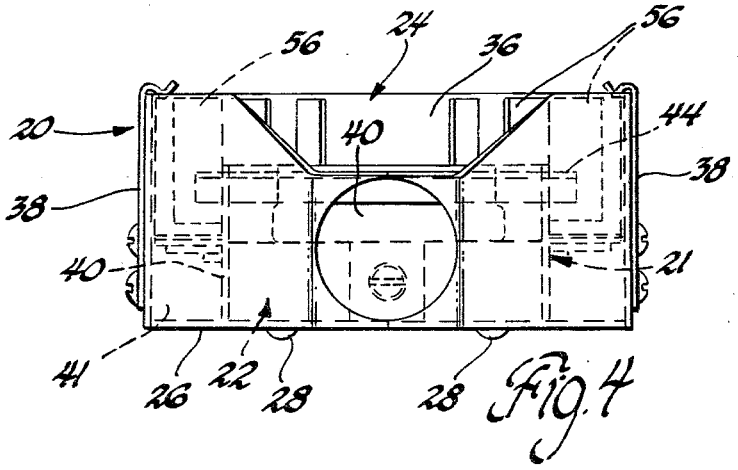
FIG. 4 is a view taken along the line 4—4 in FIG. 2.

An air shroud device 20 according to the present invention is adapted to be received about the nozzle 18 and detachably fixed to the gun for delivering a uniform shroud of air about the paint spray issuing from the nozzle. As shown in FIGS. 2–4, the air shroud device 20 comprises three main parts; namely, a vaned insert 21, a collar 22 and a shell 24. The shell 24 is secured at a back wall 26 thereof by screws 28 to the collar 22 which is received about the nozzle 18. The collar 22 is simply detachably fixed to the gun by having channels 30 which engage the normal butterfly wings 32 on the nozzle and by further having a ball nosed spring plunger 34 which engages a dimple 35 formed on the nozzle. The vaned insert 22 is received between the collar 22 and a side wall 36 of the shell 24 and is retained in place against the back wall 26 by a pair of spring clips 38 which are fastened to the outer side of the side wall 36 on opposite sides of the collar. The vaned insert 21 has an annular side wall 40 which extends to the back wall 26 of the shell 24 and is spaced radially inwardly from the side wall 36 of the shell. The side walls 36 and 40 are parallel to each other and to the centerline of the spray nozzle 18 and in cooperation with the back wall 26 form an annular air passage 41 extending about the nozzle. The side wall 36 and back wall 26 of the shell 24 form a tapered three-sided section 42 at the lower end of the shell that is closed by a cover plate 44 and together therewith is joined to a short circular pipe 46 to which a hose 48 is secured by a clamp 50. The hose 48, in turn, is connected to a suitable source of air (not shown) of the proper humidity and temperature depending upon the type of paint being sprayed.

With the inlet 46 to the air passage 41 thus provided, air is delivered in opposite directions from the inlet into the two semi-annular branches 54 of the air passage as shown by the arrows in FIG. 2. The vaned insert 21 is formed with a plurality of integral vanes 56 which are spaced along the annular side wall 40 and project radially outwardly to the side wall 36 of the shell or the cover plate 44 thus providing a series of outlets 58 which face in the same direction as the paint spray nozzle 18. As can be seen in FIG. 3, the vanes 56 do not extend to the back wall 26 of the shell 24 and instead are spaced therefrom and project at varying distances into the air passage 41 which extends therealong. The entrance edges 60 of the vanes 56 in each of the branches 54 project progressively longer distances into the air passage at successively further downstream locations relative to the inlet 46 so that the entrance edge of the vane in each branch projects further into the oncoming air than the preceeding upstream vane in this branch. The entrance edges 60 of the vanes are positioned relative to each other so as to intercept and deflect air in substantially equal amounts from the airstream passing along each branch and thereby substantially evenly distribute the air between the vanes and thus to the outlets 58 of the air shroud device so as to form a substantially uniform air shroud 61 encircling the paint spray 19 issuing from the spray nozzle 18 as shown in FIG. 1.

In addition, a series of outlets 62 of substantially smaller flow area than the outlets 58 are spaced along the branches 54 for delivering air therefrom directly toward and about the paint spray as it is issuing from the nozzle 18 to prevent paint build-up on the air shroud device. The outlets 62 are formed by circular holes which may be of equal size as shown and are located in the annular wall 40 of the vaned insert 21 on the upstream side and adjacent the entrance edge of one of the vanes. With such location, air is substantially evenly distributed between the outlets 62 and is directed radially inward or transverse to the paint spray to thereby force the paint spray away from the air shroud device. Nevertheless, there will be some paint build-up on the air shroud device and particularly the vaned insert 21 and by means of the spring clips 38 it is possible to simply remove the vaned insert for easy cleaning and then reassembly thereof.

The above described preferred embodiment is illustrative of the invention which may be modified within the scope of the appended claims.

The embodiments of the invention in which an exclusive property or privilege is claimed are defined as follows:

1. In combination with a paint spray gun having a spray nozzle, an air shroud device adapted to be received about the nozzle and detachably fixed to the gun for delivering a shroud of air about paint spray issuing from the nozzle, said air shroud device comprising an annular air passage extending about the nozzle, an inlet for delivering air in opposite directions therefrom into semi-annular branches of said air passage, a series of first outlets spaced along said branches for delivering air therefrom in the same direction as and about paint spray issuing from the nozzle, said first outlets formed in part by a series of vanes which are spaced along and extend transversely of said branches and have entrance edges which project at varying distances into said air passage, said entrance edges of said vanes in each of said branches projecting progressively longer distances into said air passage at successively further downstream locations relative to said inlet so that the entrance edge of the vane in each branch projects further into the oncoming air than the preceeding upstream vane in this branch whereby air is substantially evenly distributed between the vanes and thus to said first outlets, and a series of second outlets spaced along said branches for delivering air therefrom toward and about the paint spray where it is issuing from the nozzle to prevent paint build-up on the air shroud device, each of said second outlets being located on the upstream side and adjacent the entrance edge of one of said vanes whereby air is substantially evenly distributed between said second outlets.

2. In combination with a paint spray gun having a spray nozzle, an air shroud device adapted to be received about the nozzle and detachably fixed to the gun for delivering a shroud of air about paint spray issuing from the nozzle, said air shroud device comprising a shell having a back wall and a side wall, a vaned insert detachably secured in said shell, said vaned insert having an annular side wall cooperating with said back wall and side wall of said shell to form an annular air passage extending about the nozzle, an inlet in said shell for delivering air in opposite directions into semi-annular branches of said air passage, a series of first outlets spaced along said branches for delivering air therefrom in the same direction as and about paint spray issuing from the nozzle, said first outlets formed in part by a series of vanes on said vaned insert which are spaced along and extend transversely of said branches and have entrance edges which project at varying distances into said air passage, said entrance edges of said vanes in each of said branches projecting progressively longer distances into said air passage at successively further downstream locations relative to said inlet so that the entrance edge of the vane in each branch projects further into the oncoming air than the preceeding upstream vane in this branch whereby air is substantially evenly distributed between the vanes and thus to said first outlets, and a series of second outlets spaced along said branches for delivering air therefrom toward and about the paint spray where it is issuing from the nozzle to prevent paint build-up on the air shroud device, each of said second outlets being located in said annular side wall of said vaned insert on the upstream side and adjacent the entrance edge of one of said vanes whereby air is substantially evenly distributed between said second outlets.

* * * * *

UNITED STATES PATENT AND TRADEMARK OFFICE

CERTIFICATE OF CORRECTION

PATENT NO. : 4,218,019

DATED : August 19, 1980

INVENTOR(S) : Jack W. Baldwin; Jonathon D. Carlson

It is certified that error appears in the above—identified patent and that said Letters Patent is hereby corrected as shown below:

Column 2, line 36, "vaned insert 22" should be -- vaned insert 21 --.

Signed and Sealed this

*Sixth* Day of *January 1981*

[SEAL]

*Attest:*

SIDNEY A. DIAMOND

*Attesting Officer*

*Commissioner of Patents and Trademarks*